US005800614A

United States Patent [19]

Foust

[11] Patent Number: 5,800,614

[45] Date of Patent: Sep. 1, 1998

[54] ADHESIVE APPLIER FOR SCREEN PRINTING MACHINE

[76] Inventor: Paul William Foust, 510 Pine St., Camden, S.C. 29020

[21] Appl. No.: 718,772

[22] Filed: Sep. 24, 1996

[51] Int. Cl.[6] ..... B05C 5/00; B05C 11/06; B05C 17/06

[52] U.S. Cl. ..... 118/315; 118/63; 118/600; 101/126

[58] Field of Search ..... 118/63, 70, 600, 118/100, 101, 104, 123, 313, 315, 216; 101/93, 193, 474, 126; 156/384, 388, 578; 68/200

[56] References Cited

U.S. PATENT DOCUMENTS

| | | | |
|---|---|---|---|
| 3,199,789 | 8/1965 | James | 239/423 |
| 3,667,426 | 6/1972 | Vertegaal | 118/123 |
| 4,408,562 | 10/1983 | DeCamp et al. | 118/669 |
| 4,875,268 | 10/1989 | Szarka | 29/283 |
| 5,056,462 | 10/1991 | Perkins et al. | 118/683 |
| 5,090,313 | 2/1992 | Chapman | 101/129 |
| 5,302,202 | 4/1994 | Zimmer | 118/100 |
| 5,409,733 | 4/1995 | Boger et al. | 427/96 |
| 5,418,009 | 5/1995 | Raterman et al. | 427/207.1 |
| 5,429,840 | 7/1995 | Raterman et al. | 427/256 |

*Primary Examiner*—David A. Simmons
*Assistant Examiner*—Calvin Padgett
*Attorney, Agent, or Firm*—Michael A. Mann

[57] ABSTRACT

A device is disclosed for applying adhesive to platens of a textile screen printing machine as the platens move from the unload stage to the load stage. The device comprises a frame mountable to the screen printing machine so that it extends over the moving platens, at least one interconnectable housing carried by the frame. Each housing has an array of adhesive-depositing nozzles and adhesive-spreading air nozzles plus a drying nozzle. As a platen passes under the housings, a sensor initiates the array of adhesive nozzles to deposit columns of adhesive onto the platens. Then the air nozzles spread the columns of adhesive by blowing air onto the columns. Finally, the spread adhesive is dried by gas from the drying nozzle, preferably directing a single curtain of air under pressure onto the adhesive. The housings are modular so that the device can be used with larger platens by simply adding one or more housings.

32 Claims, 7 Drawing Sheets

Fig 5
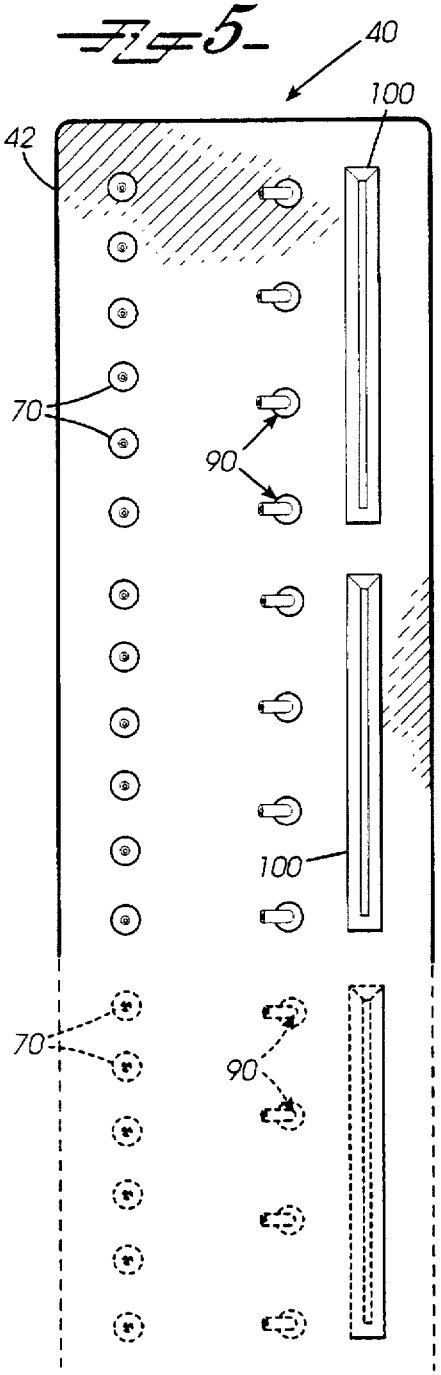
Fig 4A
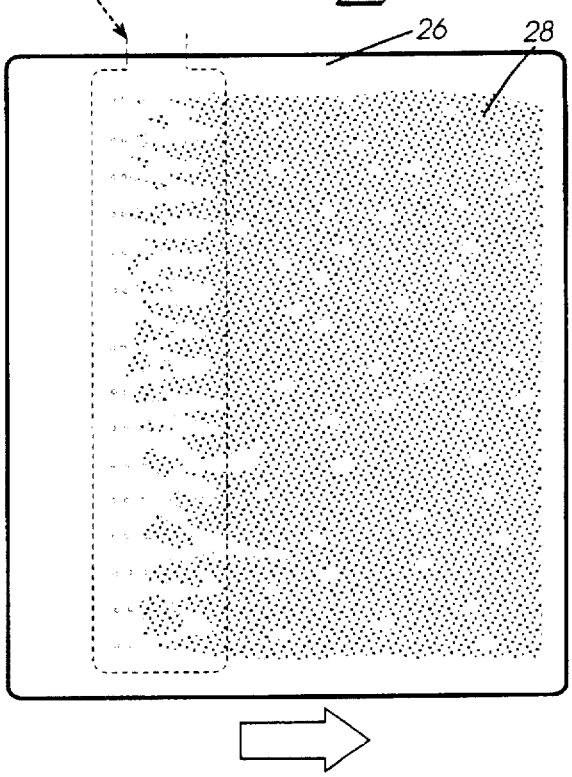
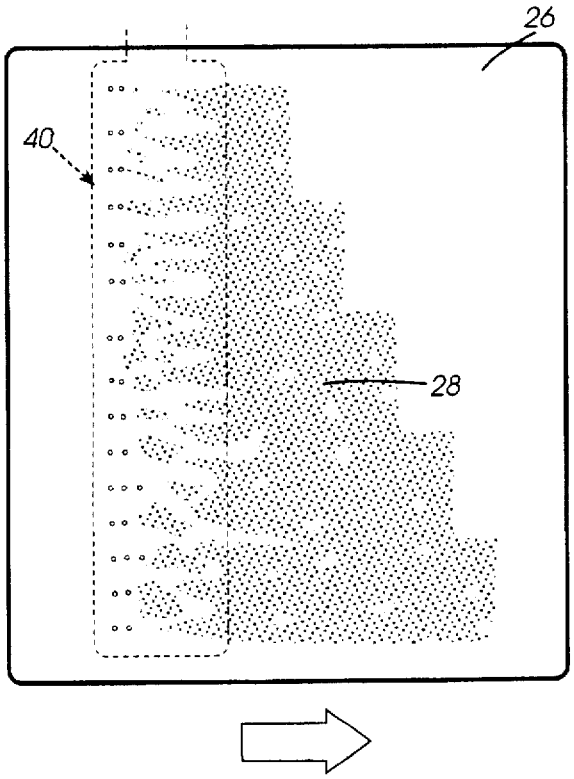
Fig 4B

ADHESIVE APPLIER FOR SCREEN PRINTING MACHINE

BACKGROUND OF THE INVENTION

1. Field of the Invention

The present invention relates to screen printing apparatus and methods. In particular, the present invention relates to the application of adhesives to the platen of a screen printing machine in order to secure the fabric to the platen prior to printing.

2. Discussion of Background

Screen printing on fabrics, especially on T-shirts, is a big business and one that has become technologically advanced. As a result, the designs printed on T-shirts have also advanced, becoming more and more colorful and complex. The need to accurately register the colors with each other has never been more important. Not only does registration demand that each color be applied in a precise physical relationship to every other color, but it also requires that the fabric be securely held to the platen so that all the colors can be applied to the same area of the fabric and the fabric does not shift on the platen as it moves from color to color.

Screen printing is typically carried out on machines having a plurality of platens or surfaces that rotate about a stationary frame in a circular or oval track. The platens move from stage to stage, stopping for an operation, such as the printing of a single color, and then moving on to the next operation, perhaps a next color. A minimum of two operators operate the machine: one putting a new piece of fabric on a platen and one taking the printed fabric off. In order to hold the fabric in place, the platen is sprayed with an adhesive.

In the past solvent-based adhesives sprayed from a spray can were used. These adhesives are tacky when wet but not tacky after the solvent evaporates. However, these adhesives pose environmental and respiratory concerns. Subsequently, water-based adhesives have come into use. Unlike solvent-based adhesives, water-based adhesives are tacky when dry. Although the environmental and respiratory concerns are now reduced, there remains a concern about these adhesives that was less of a concern before, namely, overspray. The water-based adhesives that are sprayed beyond the edges of the platen tend to make the surrounding components and floor tacky as they dry. Furthermore, overspraying of water-based adhesives is both wasteful and costly. In a competitive, large-volume screen-printing business, the cost of the overspray becomes significant, as well as the cost of removing the oversprayed adhesives from surrounding surfaces.

The art has not recognized, let alone addressed, the problem of overspraying adhesives in screen printing. For example, in U.S. Pat. No. 5,090,313, Chapman teaches a solution to the problem of maintaining registry of screens by using a two-part platen. Although he describes screen printing generally, he only briefly describes the use of adhesives to secure the T-shirt to the platen at Col. 2, lines 64 et seq., and does not teach how the adhesive is applied. Szarka, in U.S. Pat. No. 4,875,268, describes the use of a sleeve rather than adhesives for holding a T-shirt to a platen in screen printing for good registration, and therefore does not appear to use any type of adhesive.

In other arts, there are techniques known in the application of adhesives to moving surfaces. The use of air to assist in the application process is known. However, the concerns about the way the adhesive is applied are different.

For example, in the two patents issued to Raterman, et al., U.S. Pat. No. 5,429,840 and 5,418,009, and one issued to Boger, et al., U.S. Pat. No. 5,409,733, the patentees describe the application of adhesives to a moving substrate. In particular, the deposition of the adhesives is controlled in part by a flow of air during and after the adhesive hits the substrate. However, the focus of these patents is the application of thick adhesive coatings with square or sharp cut-off/cut-on patterns in such applications as the manufacture of laminates, rather than screen printing where the bonding of the fabric to the platen is temporary. All three patents teach a slot-type nozzle for the application of the liquid to the substrate with air jets directed on either side of the central nozzle and angled toward it. Thus, in all of these, air is used to limit the shape of the applied liquid but not to spread it.

Like Raterman, et al. and Boger, et al., Perkins, et al., in U.S. Pat. No. 5,056,462, describe the application of a coating to a moving substrate. Their concern lies partially in the distribution of the coating on the substrate but primarily in the correlation between the deposition rate of the coating and the speed of the conveyor that moves the substrate.

DeCamp, et al. also describe a device for depositing adhesive onto a moving substrate in U.S. Pat. No. 4,408,562. Specifically, DeCamp, et al. address the problem of "trailing" the glue from the area where it is supposed to be applied, to an area where it is not to be applied. Pressurized air from a nozzle is used to prevent trailing by blowing horizontally at the adhesive nozzle after the adhesive nozzle stops depositing adhesive. DeCamp, et al., like several of the other references described above, are concerned with limiting the spread of adhesive with air jets rather than causing it. Furthermore, their air jet is directed at the nozzle rather than at the substrate.

Other arts also teach the use of plural nozzles in gluing two materials together. Use of an array of liquid nozzles in combination with an array of air nozzles to coat a stationary substrate is described by James in U.S. Pat. No. 3,199,789. The arrays can each be a single row of nozzles, as disclosed in Col. 2 at lines 33 et seq. James arranges his nozzles in a way that prevents them from overspraying as a result of turbulence between air and adhesive, but not as a result of simply overspraying when trying to cover the entire surface.

Although many of these references use air to control the distribution of a fluid over the surface of a substrate, certainly none of them suggest, teach or describe a way to quickly apply and dry a water-based adhesive to a moving substrate. Therefore, there is a need for a device that can be used on a screen printing machine to apply water-based adhesive to the platens quickly and without overspray.

SUMMARY OF THE INVENTION

According to its major aspects and broadly stated, the present invention is a device for applying a water-based adhesive to the moving platens of a screen printing machine. The device comprises an arm that extends over the oncoming platens and holds a series of nozzles for depositing columns of adhesive on the moving platens, followed by a series of air nozzles for dispersing the adhesive columns over the surface of the platen, followed by an air dryer to evaporate sufficient water from the adhesive before the next unprinted fabric is placed on the platen. A control system assures that the adhesive starts flowing onto the moving platens as soon as they arrive at the station where the arm is mounted, and that the adhesive stops flowing before the platens move out of range.

The use of nozzles to apply thin columns of adhesive to the platens is an important feature of the present invention.

The nozzles can apply adhesive to the platen so that all of the adhesive goes onto the platen and none is applied on any other surface; thus, there is no waste.

The use of a series of adhesive nozzles and a series of dispersing blowers is another important feature of the present invention. The combination of adhesive nozzles and blower nozzles assures that the adhesive is applied evenly and to a substantial area of the platen. In fact, it is a significant feature of the present invention that it recognizes the fact that the adhesive does not have to completely cover the platen, and therefore that use of a spray for covering the platen, which inherently would include the overspray, is not needed.

The inclusion of a dryer is also an important aspect of the present invention, because the dryer assures rapid drying of the adhesive so that the next fabric can be placed on the platen as soon as it reaches the "load" station.

Another important feature of the present invention is that the device is designed to be modular. Platens are not all the same length; rather, they range from eight inches to forty inches. The device is therefore preferably constructed to be eight inches wide and to have connections to link up to five of them in a single arm stretching out over the platen.

Other features and advantages of the present invention will be apparent to those skilled in the art from a careful reading of the Detailed Description of a Preferred Embodiment presented below and accompanied by the drawings.

BRIEF DESCRIPTION OF THE DRAWINGS

In the drawings,

FIGS. 4A and 4B illustrate two examples of adhesive patterns applicable to platens by a device, shown in ghost, according to a preferred embodiment of the present invention;

FIG. 5 is a bottom view of an adhesive applying device according to a preferred embodiment of the present invention;

DETAILED DESCRIPTION OF A PREFERRED EMBODIMENT

The present invention is designed to take the place of spray cans of solvent-based adhesives and sprayers of water-based adhesives used in the prior art and to replace them with a device that applies a coating of adhesive on the platen in such a way as to avoid overspray. Overspray means the deposit of significant quantities of adhesive on surfaces where it does not help hold a fabric to a platen for screen printing. Overspray includes spraying adhesive on the screen printing machine, the floor, surrounding equipment, and on those parts of the platen where there will be no fabric. Overspray also includes spraying on areas of the platen where no spray is needed to hold the fabric, regardless of whether a portion of the fabric will be placed thereon.

Figure 1:
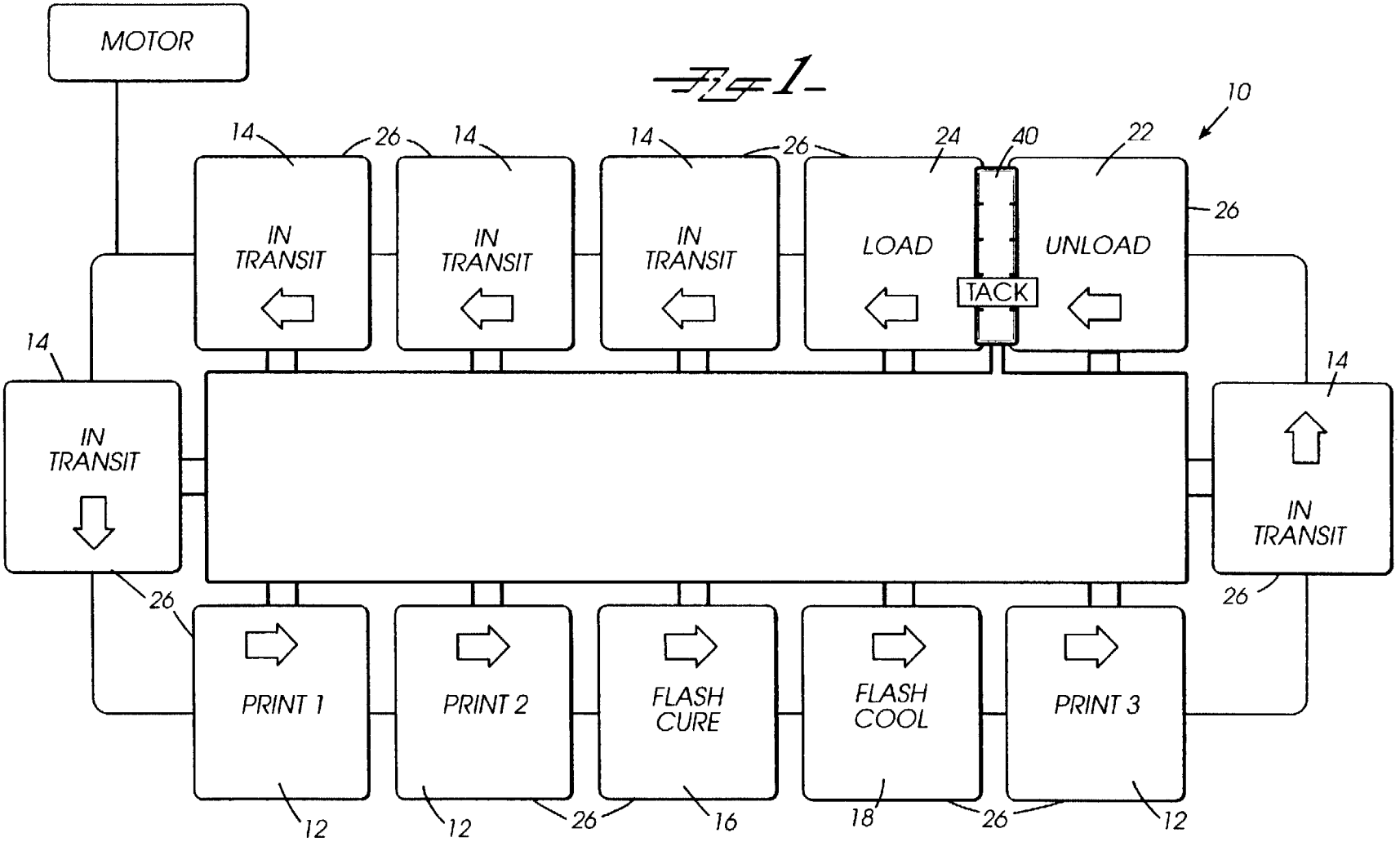
FIG. 1 is a schematic view of a screen printing operation according to a preferred embodiment of the present invention.

Referring now to FIG. 1, there is shown a schematic view of a screen printing machine generally indicated by reference number 10. Screen printing machine 10 is shown as a conveyance in a generally oval configuration. However, the present invention is not limited to oval machines or circular or "carousel" machines, but can, in fact, be applied to any machine where platens 26 move in sequence from one position to the next and where loading of a fabric 30 onto a platen 26 is done on one position and printing is done on a subsequent position.

Machine 10 moves in stages; that is, it moves a set of platens 26 from one stage to another, stops momentarily for an operation such as printing or curing to take place, and then moves the platens 26 on to the next stages in the sequence.

Machine 10 is shown with three printing stages 12, several transit stages 14, a flash cure stage 16, and a flash cool stage 18. It also has an unload stage 22 where the printed fabric is removed and a load stage 24 where an unprinted fabric is placed on a platen.

Figure 2A:
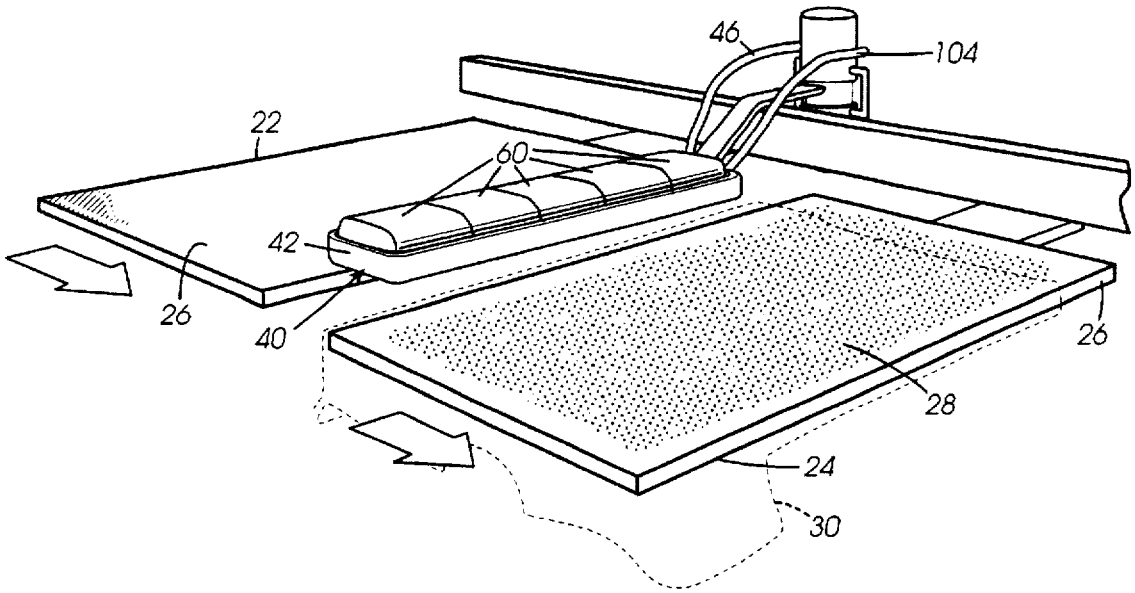
FIGS. 2A and 2B are perspective views of platens passing from the "unload" to the "load" positions under an adhesive applying device, according to a preferred embodiment of the present invention.
Figure 2B:
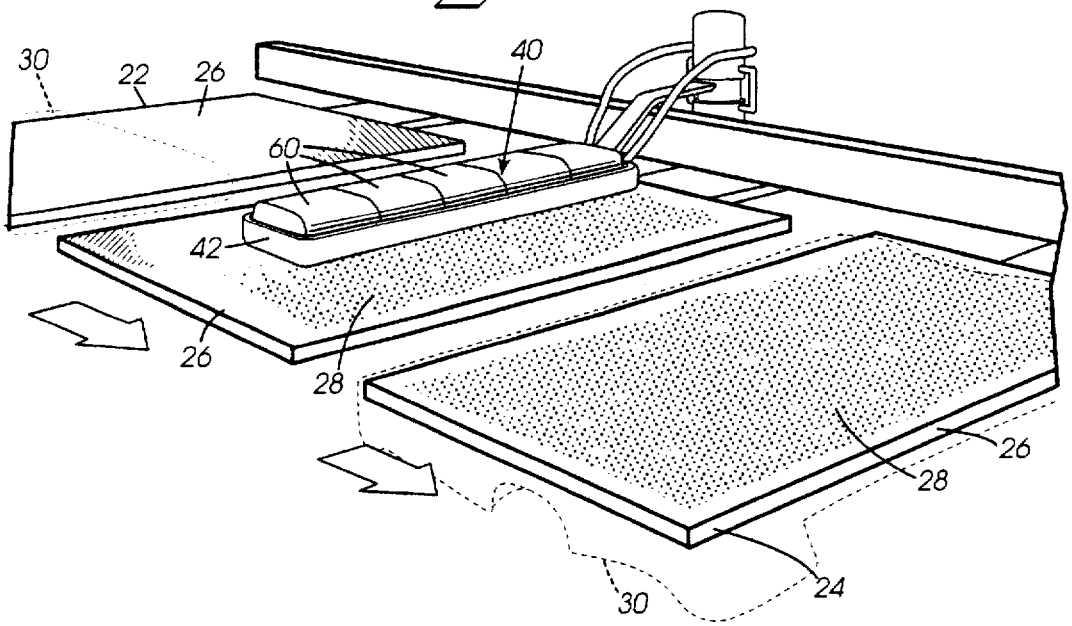

Referring also to FIGS. 2A and 2B, a device 40 according to the present invention is positioned between the "unload" stage 22 of a platen 26 and the "load" stage 24 of a platen 26. Device 40 is in the form of an arm extending at right angles to the direction of travel of platens 26, and comprises a frame 42 and one to five modular units 60 connected together. As a platen 26 moves from the unload stage 22 to the load stage 24 (FIG. 2B), device 40 applies adhesive 28 to that part of a platen 26 where adhesive 28 is desired and dries the adhesive 28 so that, by the time platen 26 has arrived at the "load stage" 24, the water-based adhesive 28 is tacky and will hold a fabric 30 to platen 26 while it is being printed. Note that other operations of machine 10 take place when the platens 26 are stopped at the various stages, but device 10 applies adhesive 28 to platen 26 between stages, when platen 26 is moving. Thus no separate stage is needed for applying adhesive 28.

FIGS. 3–7 illustrate an adhesive applying device according to a preferred embodiment of the present invention. Device 40 includes a frame 42 with one or more modular units 60 carried by the frame 42 or mounted to some other structure as long as the interconnected modular units 60 extend over the platens. Each modular unit 60 has a housing 62 with a plurality of adhesive depositing nozzles 70 arranged in an array, preferably a single row, followed by a plurality of adhesive spreading nozzles 90, also arranged in an array such as a single row, and then followed by an adhesive drying nozzle 100, preferably one that blows a thin curtain of air onto the adhesive 28. Each type of nozzle is spaced apart a predetermined distance so that none interferes with the other.

Figure 3:
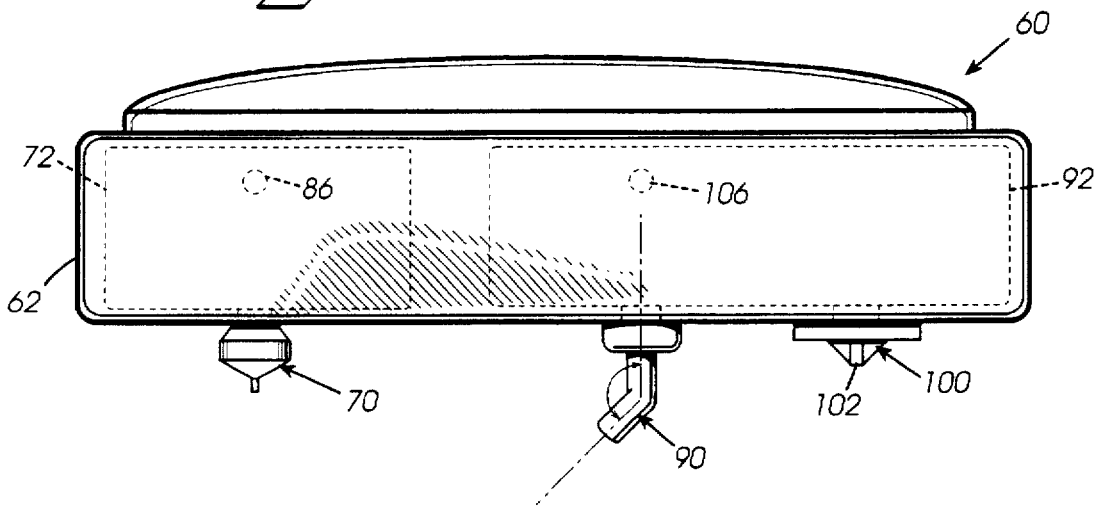
FIG. 3 is an end view of an adhesive applying device according to a preferred embodiment of the present invention.

FIG. 3 illustrates the end view of device 40 and one of the adhesive depositing nozzles 70, one of the adhesive spreading nozzles 90, and the end of the adhesive drying nozzle 100. Note that adhesive spreading nozzle 90 is spaced apart from adhesive depositing nozzle 70 and angled so that it can apply a jet of air or other gas, but preferably air, both downward toward the platen 26 and rearward toward the adhesive 28 being deposited on the platen 26. In addition, as shown in phantom lines in FIG. 3, device 40 includes an adhesive reservoir 72 in fluid communication with the adhesive depositing nozzles 70, and an air reservoir 92 in fluid communication with both the adhesive spreading nozzles 90 and the adhesive drying nozzle 100.

FIG. 5 illustrates the underside of device 40, where the row of adhesive depositing nozzles 70 is followed by the row of adhesive spreading nozzles 90, and then followed by adhesive drying nozzle 100. The direction of adhesive spreading nozzles 90, angled towards adhesive depositing nozzles 70 and towards the direction of the movement of platens 26, is also apparent in FIG. 5.

FIGS. 4A and 4B show a platen 26 on which adhesive 28 has been deposited in two patterns, one in FIG. 4A and one in FIG. 4B. Device 40 is illustrated in phantom lines and has multiple modular units 60. In FIG. 4A, platen 26 is substantially covered with adhesive 28. In FIG. 4B, however, platen 26 is not covered, but adhesive 28 application is applied in steps, with the unit 60 closest to screen printing machine 10 starting the application of adhesive 28 first, and then each unit 60 thereafter until the unit 60 furthermost from screen printing machine 10 has started the application of adhesive 28.

From FIG. 4B two advantages of modular units 60 will be appreciated. First, not all platens 26 are the same length; some are longer and some are shorter. The number of units 60 used will be different depending on the length of platen 26. Second, not all fabrics 30 being temporarily adhered to platen 26 will be the same shape; therefore, the adhesive 28 need not be applied to certain areas of platen 26 unless it is needed to secure the fabric 30. In this regard, only enough adhesive 28 need be applied to hold the fabric 30 for printing. The entire platen 26, and indeed the entire part of platen 26 that is covered by fabric 30, does not have to be covered with adhesive 28; only enough to hold fabric to platen 26.

Along these same lines, note that adhesive depositing nozzles 70 apply discrete quantities, including drops, droplets, broken rivulets and steady flows of adhesive 28, or a combination of such, which will produce, when platen 26 is in motion, a "column" or broken column of adhesive 28. Adhesive spreading nozzles 90 will blow air under pressure onto the columns of adhesive 28, causing them to spread. Columns spread out in a branch-like pattern, interconnecting and changing direction, spreading out over platen 26.

Figure 6:
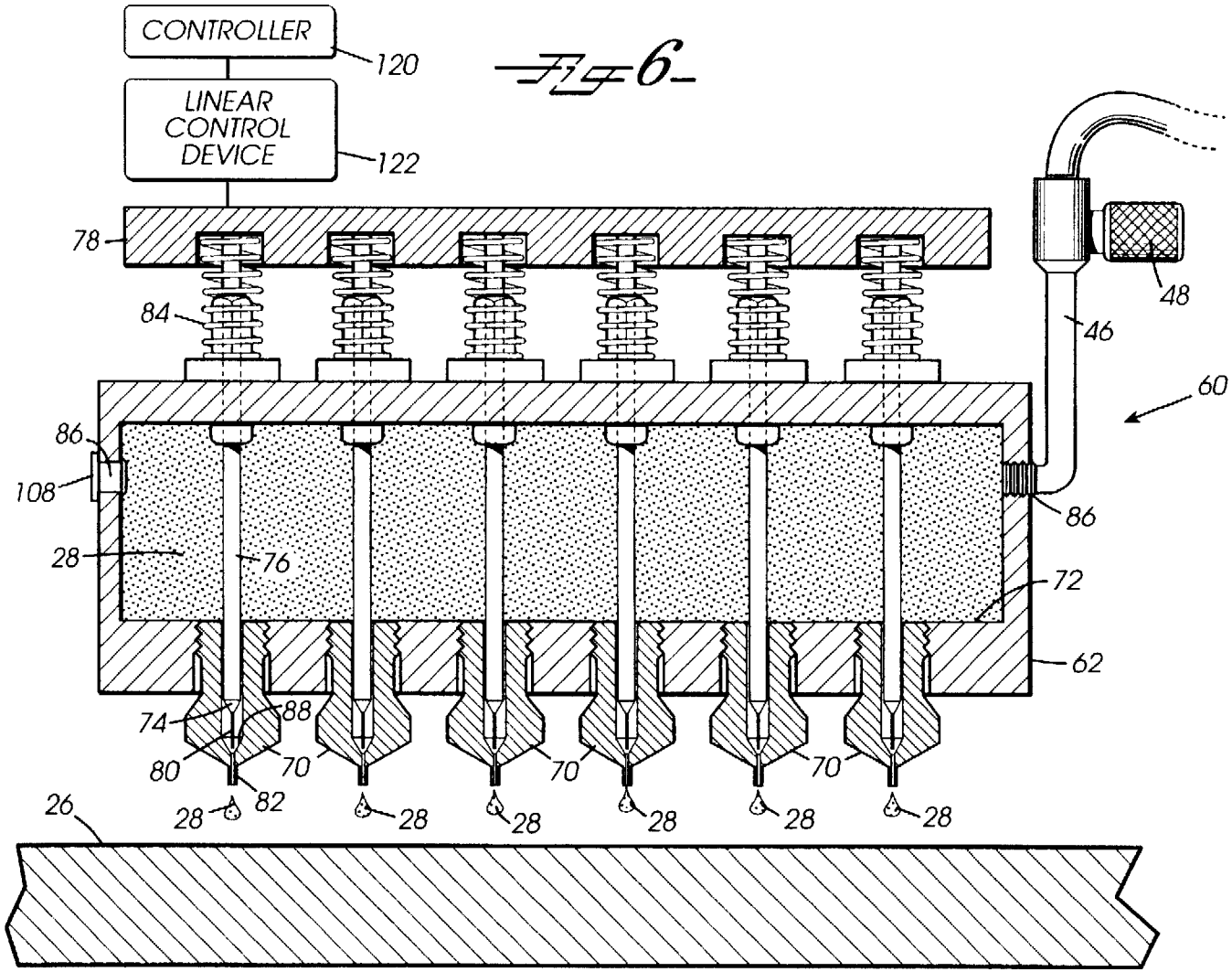
FIG. 6 is a cross-sectional side view of a device according to a preferred embodiment of the present invention, showing the adhesive applying nozzles.
Figure 7:
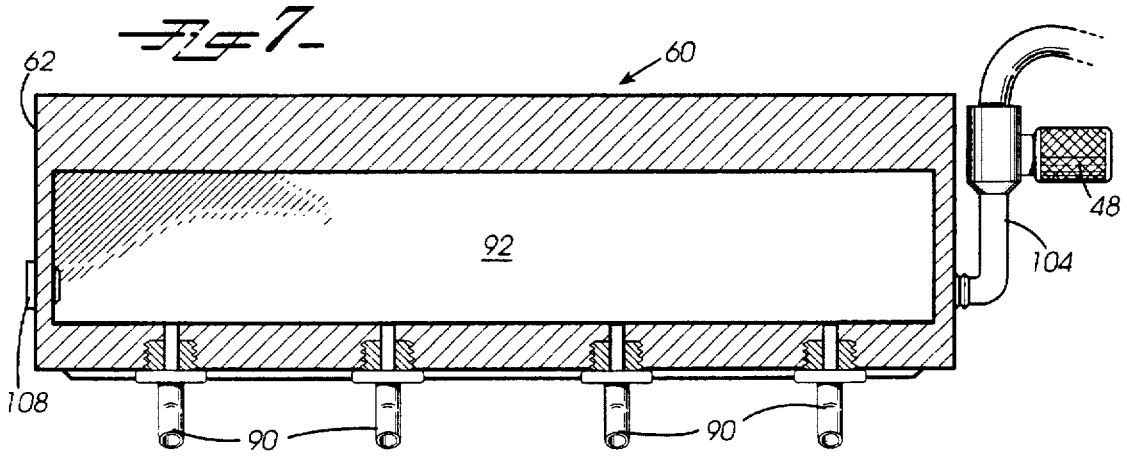
FIG. 7 is another cross-sectional view of the adhesive applying device according to a preferred embodiment of the present invention, showing the adhesive spreading nozzles.
Figure 8:
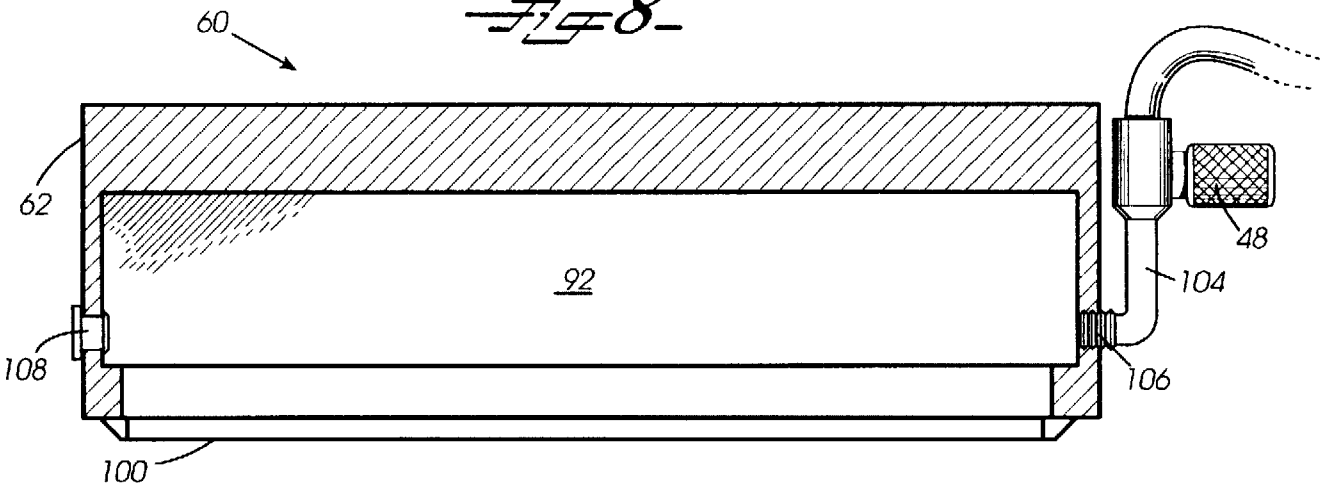
FIG. 8 is still another cross-sectional view of the adhesive applying device according to a preferred embodiment of the present invention, showing the drying nozzle.

Each modular unit 60 is identical and is interconnectable physically and fluidly with each other unit 60, as will be described below. FIGS. 6–8 show cross sections of a single unit 60 at different locations along its length, the first (FIG. 6) to show adhesive depositing nozzles 70, the second (FIG. 7) to show adhesive spreading nozzles 90, and the third (FIG. 8) to show adhesive drying nozzle 100.

FIG. 6 shows unit 60 with its housing 62 having adhesive depositing nozzles 70 in a row just above a platen 26 moving toward the viewer. Inside housing 62, adhesive reservoir 72 is formed to receive adhesive 28. Each of the adhesive depositing nozzles 70 has a fluid tip 74 connected to a rod 76 that extends through housing 62 away from platen 26. Rods 76 of fluid tips 74 are interconnected by a bar 78 so that each one operates in a coordinated fashion with the other rather than independently. Each fluid tip 74 is cone-shaped, terminating in a pin 80 that fits into a hole 82 in the end of adhesive depositing nozzle 70. The interior of adhesive depositing nozzle 70 has a complementing design, so that when fluid tip 74 is in its downward most position, pin 80 extends within hole 82, and the conical shape of fluid tip 74 seats against the funnel shaped interior surface 88 of the adhesive depositing nozzles 70. In this position, adhesive 28 is prevented from exiting the adhesive depositing nozzle 70.

The movement of fluid tips 74 is controlled by the movement of bar 78. Concentrically aligned about each rod 76 and biased between bar 78 and rods 76 are individual compression springs 84. Compression springs 84 bias fluid tips 74 in an open position, such that the cone-shaped surface of fluid tip 74 is in spaced relation to the interior surface 88 of adhesive depositing nozzle 70 to create an annular channel for adhesive 28 to flow through. In this open position, pin 80 is removed from hole 82, as shown in FIG. 6. In order to close adhesive depositing nozzles 70 and prevent adhesive 28 from flowing, bar 78 is pressed downward against rods 76 to close each nozzle 70, as described above. When bar 78 is forced downward, pin 80 enters hole 82 and removes any excess adhesive 28 from hole 82 and keeps hole 82 clear, in order to prevent clogging.

In addition, adhesive 28 is kept under pressure so that it flows readily from adhesive depositing nozzles 70 when they are open. Adhesive 28 is fed into adhesive reservoir 72 of unit 60 through hose 46 which is connected to an adhesive source 132 that supplies adhesive reservoir 72 with a pressurized source of adhesive 28. (See FIG. 10) When two or more units 60 are connected together, adhesive 28 flows from one unit 60 to the next through a fluid connection 86 and out of that unit 60 into a subsequent unit 60. Hose 46 can be closed by operation of valves 48, thus limiting the flow of adhesive 28 into the units 60.

As shown in FIG. 3 and FIG. 7, adhesive spreading nozzles 90 and adhesive drying nozzle 100 are connected to an air reservoir 92. In a preferred embodiment, adhesive spreading nozzles 90 are threadably inserted within housing 62, so that adhesive spreading nozzles 90 are in fluid communication with air reservoir 92. In addition, adhesive spreading nozzles 90 are angled towards adhesive depositing nozzles 70, so that air exits adhesive spreading nozzles 90 towards the adhesive depositing nozzles 70 against the movement of platens 26, as more specifically shown in FIG. 10. In a preferred embodiment, adhesive spreading nozzles 90 are at an angle of approximately 45°. However, it will be recognized that other angles will be possible, so long as adhesive spreading nozzles 90 function to spread adhesive 28 about platen 26.

Figure 10:
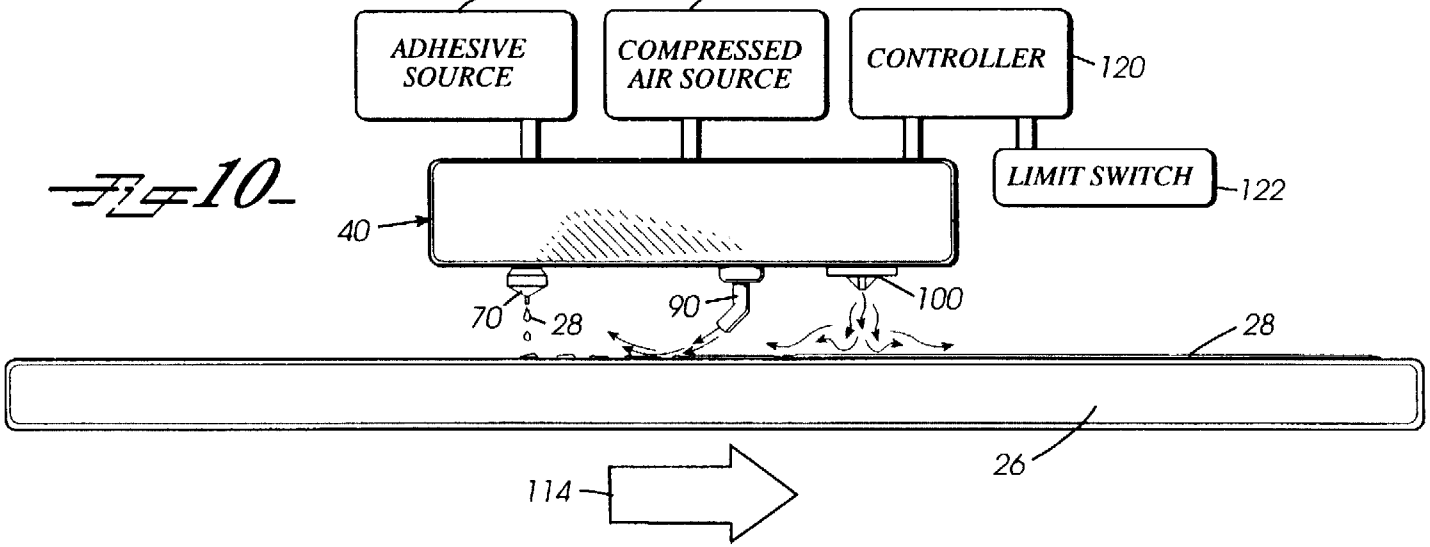
FIG. 10 is a partial schematic, partial end view of the adhesive applying device showing the operation of all three nozzle types in relation to the moving platen.

As illustrated in FIG. 8 and FIG. 10, adhesive drying nozzle 100 preferably comprises a thin slot 102 extending within housing 62, parallel to the array of adhesive depositing nozzles 70 and adhesive spreading nozzles 90. Adhesive drying nozzle 100 is fluidly connected to air reservoir 92, just as adhesive spreading nozzles 90, so that a thin curtain of air is blown onto adhesive 28 after being deposited and spread on platen 26.

Also shown in FIG. 8 and FIG. 10 is an air hose 104 connected to a pressurized air source 130 which supplies pressurized air to air reservoir 92. Because adhesive spreading nozzles 90 and adhesive drying nozzle 100 are fluidly connected to the same air reservoir 92, only a single source of air is required for the operation of the two nozzles 90, 100. Air hose 104 is also provided with a valve 48 that can be used to restrict the flow of air into air reservoir 92. Furthermore, when two or more units 60 are connected to one another, an air connection 106 is provided so that the air reservoir 92 of other units 60 may be connected to the single source. However, as in the fluid connection 86 connecting the adhesive reservoirs 72, the end unit 60 of a series of units 60 is plugged by a stop 108, so that there is no exhaust of adhesive or air from the device 40, except where desired by adhesive depositing nozzles 70, adhesive spreading nozzles 90 and adhesive drying nozzles 100, respectively.

Additionally, it will be recognized that adhesive depositing nozzles 70, adhesive spreading nozzles 90, and adhesive drying nozzles 100 are in spaced relation, as best seen in FIG. 10. Platens 26 move in the direction indicated by the arrow 114 in FIG. 10, such that device 40 operates in a three-step process in order to achieve a tacky surface on the platen 26. The adhesive 28 is applied in the first step. Then it is dispersed. Finally, in the third step, excess water is removed so that the adhesive 28 is tacky. By tacky, it is meant that the surface of the adhesive 28 is sticky enough to hold the fabric 30 in place, but not so sticky that the adhesive 28 prevents removal of the fabric 30 or that adhesive 28 adheres to the fabric 30 when the fabric 30 is removed from the platen 26.

The application of adhesive 28 and the operation of the three steps are achieved by a controller 120. The controller 120 has limit switches 122 or possibly other devices that can ascertain the position of a platen 26. Once platen 26 is in position, adhesive depositing nozzles 70 are opened by raising bar 78 so that fluid tip 74 is in spaced relation to the interior surface 88 of the adhesive depositing nozzle 70, thus creating an annular channel for adhesive 28 to flow through. The movement of bar 78 and the opening and closing of adhesive depositing nozzles 70 is controlled by controller 120 which activates a linear control device 124 such as a servo, linear actuator or air cylinder as shown in FIG. 6. The depositing of discrete amounts of adhesive 28 onto platens 26 is timed by the limit switches 122, which can also control the supply of air to the adhesive spreading nozzles 90 and adhesive drying nozzles 100. However, during a series of printing operations, air may be permitted to flow freely from device 40.

Additionally, controller 120 may be used to check the supply of adhesive 28 within adhesive reservoir 72 or to confirm the presence of pressurized air within air reservoir 92. If either is absent, then controller 120 can activate an alarm or stop the printing process, until the error is corrected.

In operation, adhesive depositing nozzles 70 deposit thin parallel columns of adhesive 28 onto the moving platen 26. It is not necessary that the columns be continuous; they may be broken up into droplets. Adhesive 28 flows onto a moving platen 26, as shown in FIG. 10, so that the deposited adhesive 28 is carried toward adhesive spreading nozzles 90, where air flowing through adhesive spreading nozzles 90 toward the oncoming adhesive 28 spreads the adhesive 28 about the platen 26. Preferably, air at 30–40 psi is directed from each of the adhesive spreading nozzles 90 to the columns of adhesive 28 to disperse them over a broader surface area of the platen 26. To better control the direction of dispersal, adhesive spreading nozzles 90 are angled as described above. After passing the adhesive spreading nozzles 90, the adhesive 28 is dried by forced air from the adhesive drying nozzle 100, preferably until adhesive 28 is tacky.

Figure 9:
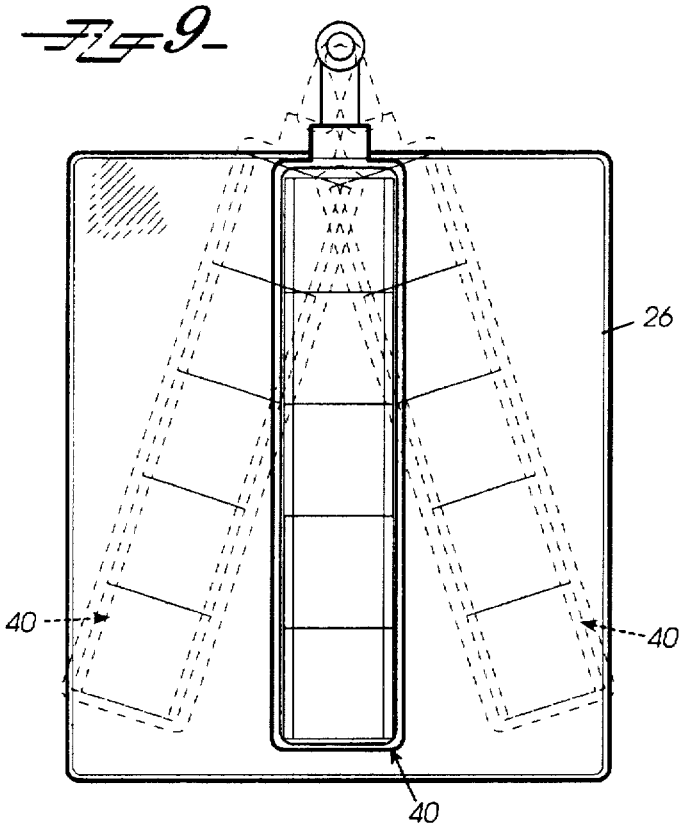
FIG. 9 is a top view of the adhesive applying device showing its ability to rotate from its securement.

When the individual units 60 are combined to complete device 40 in the form of an arm, the device 40 comprises a frame 42 with one to five modular units 60 that are interconnected to controller 120, a source of water-based adhesive 28, an adhesive pump, and a source of compressed air 130. In addition, when device 40 is mounted to screen printing machine 10, device 40 is pivotally mounted so that it is biased to a center position, perpendicular to the direction of travel of platens 26, as shown in FIG. 9. However, device 40 is mounted so that if device 40 is contacted or struck by an object, device 40 will pivot out of the way, to allow the object to pass. For example, if an obstruction carried by platen 26 passes device 40, the obstruction may damage the device 40 if it were not able to pivot away from the obstruction.

It will be apparent to those skilled in the art that many changes and substitutions can be made to the preferred embodiment herein described without departing from the spirit and scope of the present invention as defined by the appended claims.

What is claimed is:

1. A device for applying an adhesive to platens carried by a textile screen printing machine, said device comprising:

a housing adapted to mount to the screen printing machine so that said housing extends over the platens carried by the screen printing machine;

a plurality of adhesive nozzles carried by said housing for depositing discrete quantities of adhesive down onto the platens; and means carried by said housing and spaced apart from said depositing means for spreading said discrete quantities of adhesive over the platens.

2. The device as recited in claim 1, further comprising means carried by said housing and spaced apart from said spreading means for drying the adhesive on the platens.

3. The device as recited in claim 1, wherein said housing is mounted to the screen printing machine in such a way that when the screen printing machine is in operation, said housing is stationary with respect to the screen printing machine while the platens move with respect to said housing, said depositing means depositing said discrete quantities of adhesive onto the platens as the platens move past said housing.

4. The device as recited in claim 1, further comprising means for moving said platens with respect to said housing, and wherein said housing is mounted to the screen printing machine in such a way that when the screen printing machine is in operation, said housing is stationary with respect to the screen printing machine while the platens move with respect to said housing, said spreading means spreading said discrete quantities of adhesive over the platens as the platens move past said housing.

5. The device as recited in claim 1, further comprising means for moving said platens with respect to said housing; and means carried by said housing and spaced apart from said spreading means for drying the adhesive, and wherein said housing is mounted to the screen printing machine in such a way that when the screen printing machine is in operation, said housing is stationary with respect to the screen printing machine while the platens move with respect to said housing, said drying means drying the adhesive on the platens as the platens move past said housing.

6. The device as recited in claim 1, further comprising means for moving said screen printing machine in stages, wherein the screen printing machine stops at each stage momentarily for an operation to take place at one or more of the stages, and wherein said device is mounted to the screen printing machine between two adjacent stages.

7. The device as recited in claim 1, wherein said housing further comprises a reservoir formed therein for holding a quantity of adhesive, and wherein said adhesive depositing means is in fluid communication with said reservoir.

8. The device as recited in claim 1, further comprising means carried by said housing and spaced apart from said spreading means for drying the adhesive on the platens and wherein said housing is mounted to the screen printing machine in such a way that when the screen printing machine is in operation, said housing is stationary with respect to the screen printing machine while the platens move with respect to said housing, said depositing means depositing said discrete quantities of adhesive onto the platens as the platens move past said housing.

9. The device as recited in claim 1, further comprising means carried by said housing and spaced apart from said spreading means for drying the adhesive on the platens and means for moving said platens with respect to said housing and wherein said housing is mounted to the screen printing machine in such a way that when the screen printing machine is in operation, said housing is stationary with respect to the screen printing machine while the platens move with respect to said housing, said spreading means spreading said discrete quantities of adhesive over the platens as the platens move past said housing.

10. The device as recited in claim 1, further comprising means carried by said housing and spaced apart from said spreading means for drying the adhesive, and means for moving said platens with respect to said housing, and wherein said housing is mounted to the screen printing machine in such a way that when the screen printing machine is in operation, said housing is stationary with respect to the screen printing machine while the platens move with respect to said housing, said drying means drying the adhesive on the platens as the platens move past said housing and said depositing means depositing said discrete quantities of adhesive onto the platens as the platens move past said housing.

11. The device as recited in claim 1, further comprising means carried by said housing and spaced apart from said spreading means for drying the adhesive on the platens and means for moving said screen printing machine in stages, wherein the screen printing machine stops at each stage momentarily for an operation to take place at one or more of the stages, and wherein said device is mounted to the screen printing machine between two adjacent stages.

12. A device for applying an adhesive to platens carried by a textile screen printing machine, said device comprising:

a housing adapted to mount to the screen printing machine so that said housing extends over the platens as the platens are carried past and under said housing by the screen printing machine when the screen printing machine is in operation;

a plurality of adhesive nozzles carried by said housing for depositing discrete quantities of adhesive down onto the platens; and a plurality of gas nozzles carried by said housing and spaced apart from said depositing means for spreading said discrete quantities of adhesive over the platens by blowing a gas onto said discrete quantities of adhesive.

13. The device as recited in claim 12, further comprising means carried by said housing and spaced apart from said spreading means for drying the adhesive.

14. The device as recited in claim 12, wherein adhesive nozzles of said plurality of adhesive nozzles are arranged in an array and wherein each nozzle of said plurality of nozzles deposits adhesive on the platen as the platen moves past said housing when said screen printing machine is in operation.

15. The device as recited in claim 12, wherein gas nozzles of said plurality of gas nozzles are arranged in an array and oriented so that each nozzle is directed toward said discrete quantities of adhesive deposited by one of said adhesive nozzles.

16. The device as recited in claim 12, wherein said housing is formed to have an adhesive reservoir therein and a gas reservoir therein, and wherein said adhesive nozzles are in fluid communication with said adhesive reservoir and said gas nozzles are in fluid communication with said gas reservoir.

17. The device as recited in claim 12, further comprising means for moving said platens with respect to said housing, and wherein said housing is mounted to the screen printing machine in such a way that when the screen printing machine is in operation, said housing is stationary with respect to the screen printing machine while the platens move with respect to said housing, said plurality of adhesive nozzles depositing said discrete quantities of adhesive over the platens in columns as the platens move past said housing.

18. The device as recited in claim 12, further comprising means for moving said platens with respect to said housing and means for moving said screen printing machine in stages wherein the screen printing machine stops at each stage momentarily for an operation to take place at one or more of the stages, and wherein said device is mounted to the screen printing machine between two adjacent stages so that said plurality of adhesive nozzles and said plurality of gas nozzles deposit said discrete quantities of adhesive and spread said discrete quantities of adhesive over the platens as the platens move past and below said housing from one stage to an adjacent stage.

19. The device as recited in claim 12, further comprising means carried by said housing and spaced apart from said spreading means for drying the adhesive, wherein adhesive nozzles of said plurality of adhesive nozzles are arranged in an array and wherein each nozzle of said plurality of nozzles deposits adhesive on the platen as the platen moves past said housing when said screen printing machine is in operation.

20. The device as recited in claim 12, further comprising means carried by said housing and spaced apart from said spreading means for drying the adhesive, wherein gas nozzles of said plurality of gas nozzles are arranged in an array and oriented so that each nozzle is directed toward said discrete quantities of adhesive deposited by one of said adhesive nozzles.

21. The device as recited in claim 12, further comprising means carried by said housing and spaced apart from said spreading means for drying the adhesive, wherein said housing is formed to have an adhesive reservoir therein and a gas reservoir therein, and wherein said adhesive nozzles are in fluid communication with said adhesive reservoir and said gas nozzles are in fluid communication with said gas reservoir.

22. The device as recited in claim 12, further comprising means carried by said housing and spaced apart from said spreading means for drying the adhesive, wherein gas nozzles of said plurality of gas nozzles are arranged in an array and oriented so that each nozzle is directed toward said discrete quantities of adhesive deposited by one of said adhesive nozzles, and said housing is formed to have an adhesive reservoir therein and a gas reservoir therein, and wherein said adhesive nozzles are in fluid communication with said adhesive reservoir and said gas nozzles are in fluid communication with said gas reservoir.

23. The device as recited in claim 12, further comprising means carried by said housing and spaced apart from said spreading means for drying the adhesive, wherein said housing is mounted to the screen printing machine in such a way that when the screen printing machine is in operation, said housing is stationary with respect to the screen printing machine while the platens move with respect to said housing, said plurality of adhesive nozzles depositing said discrete quantities of adhesive over the platens in columns as the platens move past said housing.

24. The device as recited in claim 12, further comprising means carried by said housing and spaced apart from said spreading means for drying the adhesive, wherein said device is mounted to the screen printing machine between two adjacent stages so that said plurality of adhesive nozzles and said plurality of gas nozzles deposit said discrete quantities of adhesive and spread said discrete quantities of adhesive over the platens as the platens move past and below said housing from one stage to an adjacent stage.

25. A device for applying an adhesive to platens carried by a textile screen printing machine, said device comprising:

a frame adapted to mount to the screen printing machine so that said frame extends over the platens as the platens are carried past and under said housing by the screen printing machine when the screen printing machine is in operation;

a housing carried by said frame;

an array of adhesive nozzles carried by said housing for depositing discrete quantities of adhesive down onto the platens in columns as the platens move past said array of adhesive nozzles; and a array of gas nozzles carried by said housing and spaced apart from said depositing means for spreading said columns of adhesive over the platens by blowing a gas onto said columns of adhesive as the platens move past said array of gas nozzles.

26. The device as recited in claim 25, further comprising means carried by said housing for drying the adhesive deposited on the platens, said drying means drying the adhesive by blowing said gas onto the adhesive.

27. The device as recited in claim 25, wherein said array of gas nozzles are angled toward the platens and toward said array of adhesive nozzles.

28. The device as recited in claim 25, further comprising means carried by said housing for drying the adhesive deposited on the platens, said drying means drying said adhesive by blowing said gas onto the adhesive, and wherein said housing is formed to have a gas reservoir, said drying means and said array of gas nozzles being in fluid communication with said gas reservoir.

29. The device as recited in claim 25, wherein said frame is dimensioned to carry a plurality of housings, each housing having means for connecting it to an adjacent housing so that more than one housing can deposit and spread adhesive onto the platens.

30. The device as recited in claim 25, further comprising sensor means in operational connection with said array of adhesive nozzles and said array of gas nozzles, said sensor means for sensing when the platens are passing under said housing.

31. The device as recited in claim 25, further comprising means carried by said housing for drying the adhesive deposited on the platens, said drying means drying the adhesive by blowing said gas onto the adhesive, wherein said array of gas nozzles are angled toward the platens and toward said array of adhesive nozzles.

32. The device as recited in claim 25, further comprising sensor means in operational connection with said array of adhesive nozzles and said array of gas nozzles, said sensor means for sensing when the platens are passing under said housing means carried by said housing for drying the adhesive deposited on the platens, said drying means drying said adhesive by blowing said gas onto the adhesive, and wherein said housing is formed to have a gas reservoir, said drying means and said array of gas nozzles being in fluid communication with said gas reservoir.

* * * * *